US008246199B2

(12) United States Patent
Chang et al.

(10) Patent No.: US 8,246,199 B2
(45) Date of Patent: Aug. 21, 2012

(54) LED ILLUMINATING DEVICE

(75) Inventors: Shao-Han Chang, Taipei Hsien (TW); Wen-Hsiang Lu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 321 days.

(21) Appl. No.: 12/768,694

(22) Filed: Apr. 27, 2010

(65) Prior Publication Data

US 2011/0103054 A1 May 5, 2011

(30) Foreign Application Priority Data

Oct. 29, 2009 (CN) ..... 2009 1 0309039

(51) Int. Cl.
*F21V 7/04* (2006.01)

(52) U.S. Cl. ..... 362/235; 362/311.02

(58) Field of Classification Search ..... 362/235, 362/247, 249.02, 298, 300, 311.02, 350
See application file for complete search history.

(56) References Cited

U.S. PATENT DOCUMENTS 8,052,307 B2 * 11/2011 Bak et al. ..... 362/311.02
8,070,326 B2 * 12/2011 Lee ..... 362/311.02

* cited by examiner

*Primary Examiner* — David V Bruce
(74) *Attorney, Agent, or Firm* — Altis Law Group, Inc.

(57) ABSTRACT

An LED illuminating device includes a first and a second illuminating module, and a connecting module connecting the first illuminating module with the second illuminating module. The first illuminating module includes a first substrate carrying a double-sided reflector, a first group of LEDs, and a second group of LEDs. The double-sided reflector divides the first illuminating module into a front lighting area and a lateral lighting area, light emitted by the first group of LEDs illuminates the front lighting area, and light emitted by the second group of LEDs illuminates the lateral lighting area. The second illuminating module includes a second substrate and a third group of LEDs mounted on the second substrate. The first group of LEDs and the second group of LEDs are opposite to the third group of LEDs, and the projections of the first substrate and the second substrate are spaced to each other.

18 Claims, 15 Drawing Sheets

A

B

LED ILLUMINATING DEVICE

CROSS-REFERENCE TO RELATED APPLICATIONS

Related subject matter is disclosed in co-pending U.S. patent application Ser. No. 12/768,691, entitled "LED ILLUMINATING DEVICE", and Ser. No. 12/768,697, entitled "LED ILLUMINATING DEVICE", which have the same inventors and assignees as named herein. The above-identified applications are incorporated herein by reference.

BACKGROUND

1. Technical Field

The present disclosure relates to illuminating devices and, particularly, to a light emitting diode (LED) illuminating device.

2. Description of Related Art

Compared to traditional illuminating devices, LED lights have many advantages such as high luminous efficiency, low radiation, power saving, long life, etc. Yet, LED lights still have disadvantages. Because light emitted by LEDs is directional, light divergence angle of the LED light is less than that of the traditional illuminating device. Referring to FIG. 12, the light divergence angle of the traditional light source is S1, the value of S1 is about 160 degrees. Referring to FIG. 13, the light divergence angle of an LED is S2, the value of S2 is about 60 degrees.

People have combined several LEDs in a single LED illuminating device to enlarge the light divergence angle of the LED illuminating device. Referring to FIG. 14, a ring shaped LED illuminating device using many substrates 10 is shown. Each substrate 10 carries LEDs 11. The light divergence angle of the LED illuminating device is enlarged, yet, more heat is produced by the LEDs 11 (shown as arrows) between the substrates 10, which makes the LED illuminating devices become too hot.

Thus, what is needed is a LED illuminating device with large light divergence angle and good heat dissipation ability.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
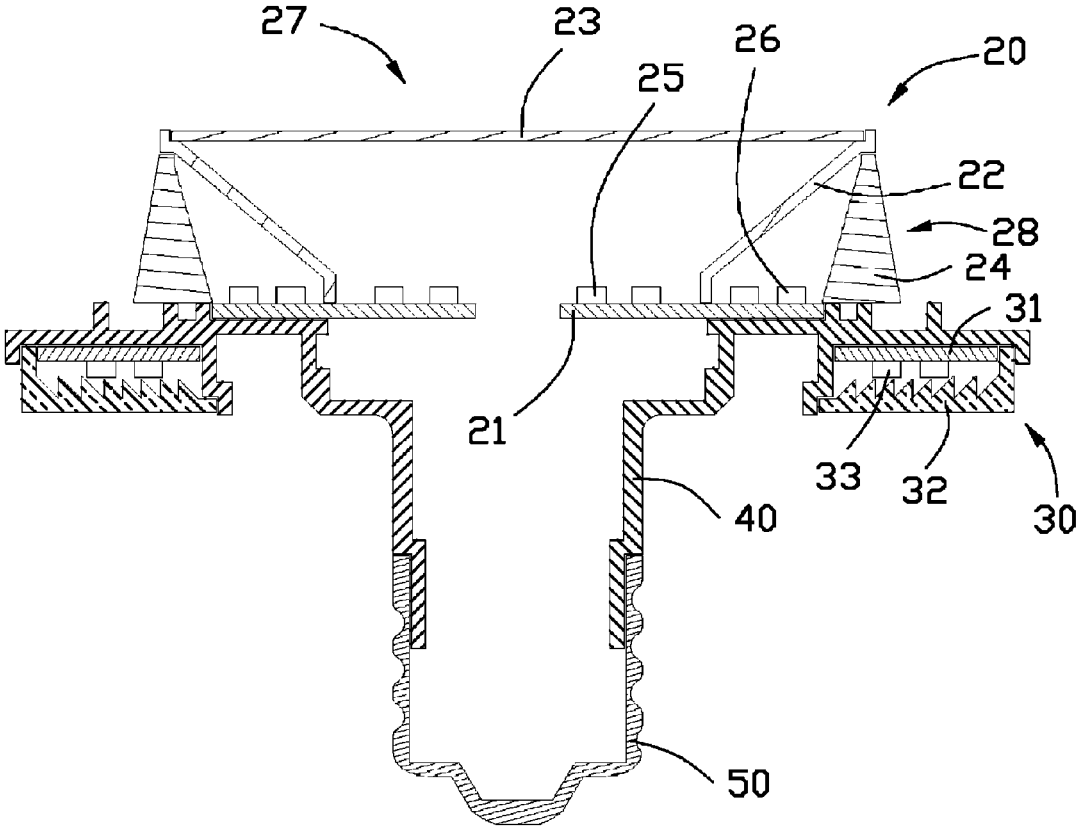
FIG. 1 is a schematic, cross-sectional view of an LED illuminating device according to a first embodiment.

Referring to FIG. 1, an LED illuminating device according to a first embodiment is disclosed. The LED illuminating device includes a first illuminating module 20, a second illuminating module 30, a connecting module 40, and a power input module 50.

The first illuminating module 20 includes a first substrate 21, a double-sided reflectors 22, a transparent front cover 23, and a transparent lateral cover 24. The substrate 21 is mounted on the connecting module 40. The substrate 21, the transparent front cover 23, and the transparent lateral cover 24 cooperate to form a first shell. The double-sided reflector 22 is mounted in the shell and divides the first illuminating module 20 into a front lighting area 27 and a lateral lighting area 28. A first group of LEDs 25 is mounted on the substrate 21 and faces the transparent front cover 23. A second group of LEDs 26 is mounted on the substrate 21 and faces the transparent lateral cover 24. The LEDs 25, 26 are mounted on the same surface of the substrate 21.

Figure 2:
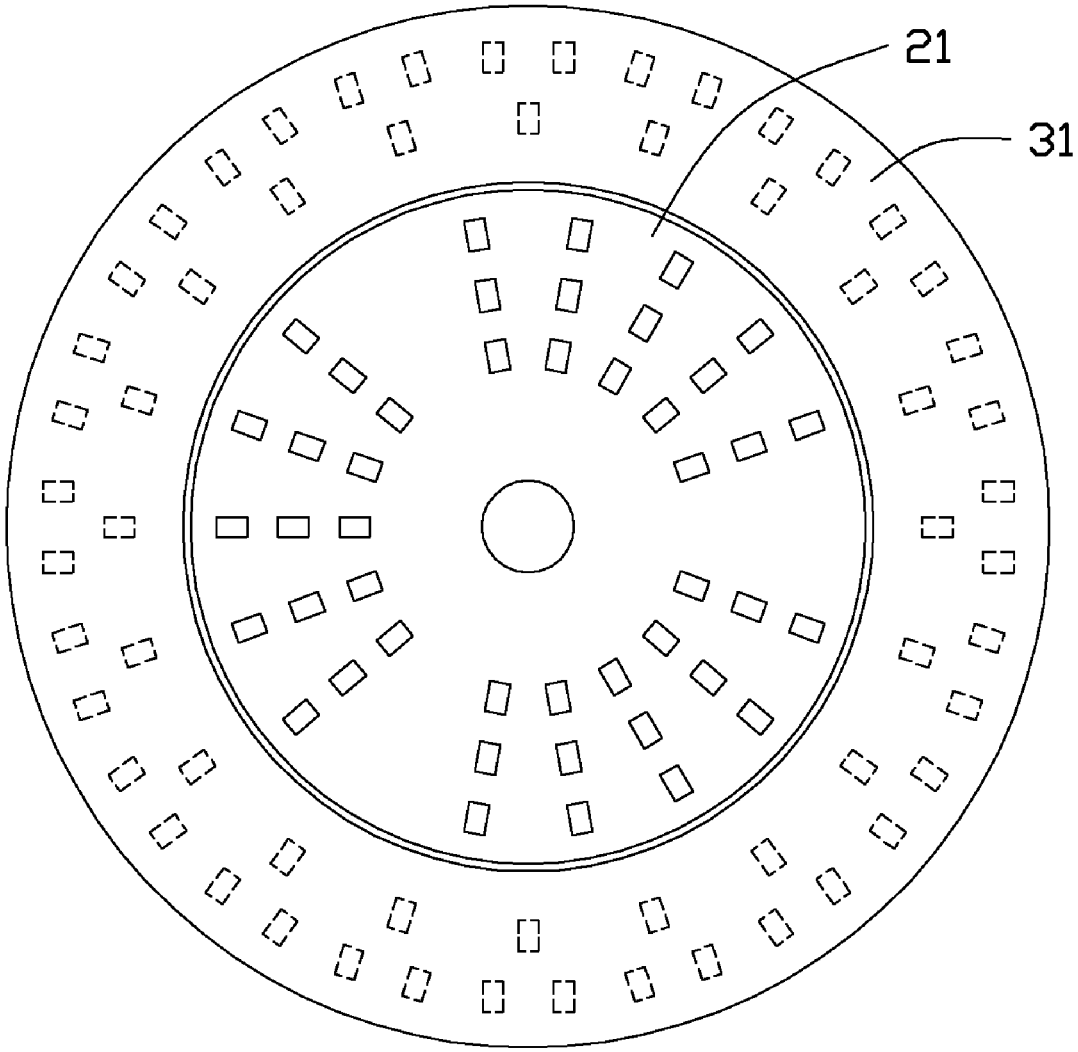
FIG. 2 is a schematic, cross-sectional view showing substrates of the LED illuminating device of FIG. 1.

The second illuminating module 30 includes a second substrate 31 and a transparent cover 32. The substrate 31 is mounted on the connecting module 40. The transparent cover 32 is mounted on the substrate 31. The transparent cover 32 and the substrate 31 together form a second shell. A third group of LEDs 33 are located in the shell and are mounted on the substrate 31. Referring to FIG. 2, the projections of the first substrate 21 and the second substrate 31 are spaced to each other.

Figure 3:
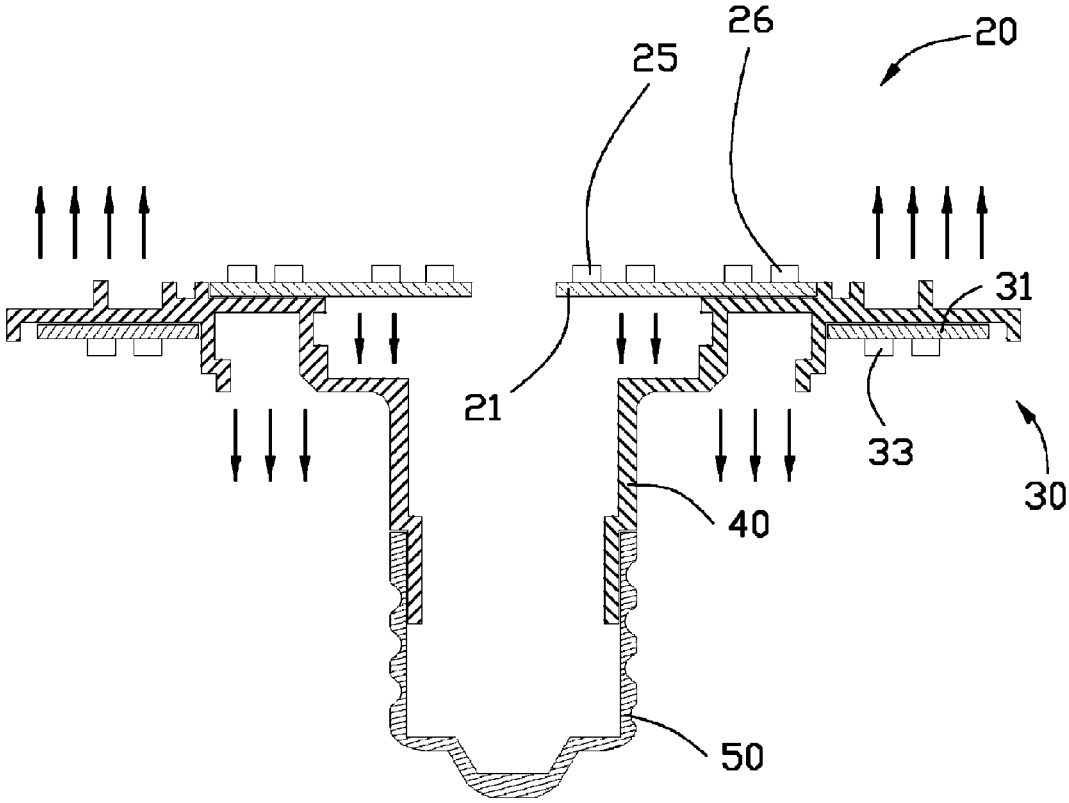
FIG. 3 is a schematic, cross-sectional view showing heat dissipation of the LED illuminating device of FIG. 1.

The first substrate 21 and the second substrate 31 face opposite directions, accordingly, the third group of LEDs 33 are also opposite to the first group of LEDs 25 and the second group of LEDs 26. Referring to FIG. 3, heat produced by the LEDs 25, 26, 33 and the substrate 21, 31 widely radiate along opposite directions, thus the heat radiation efficiency is improved.

Figure 4:
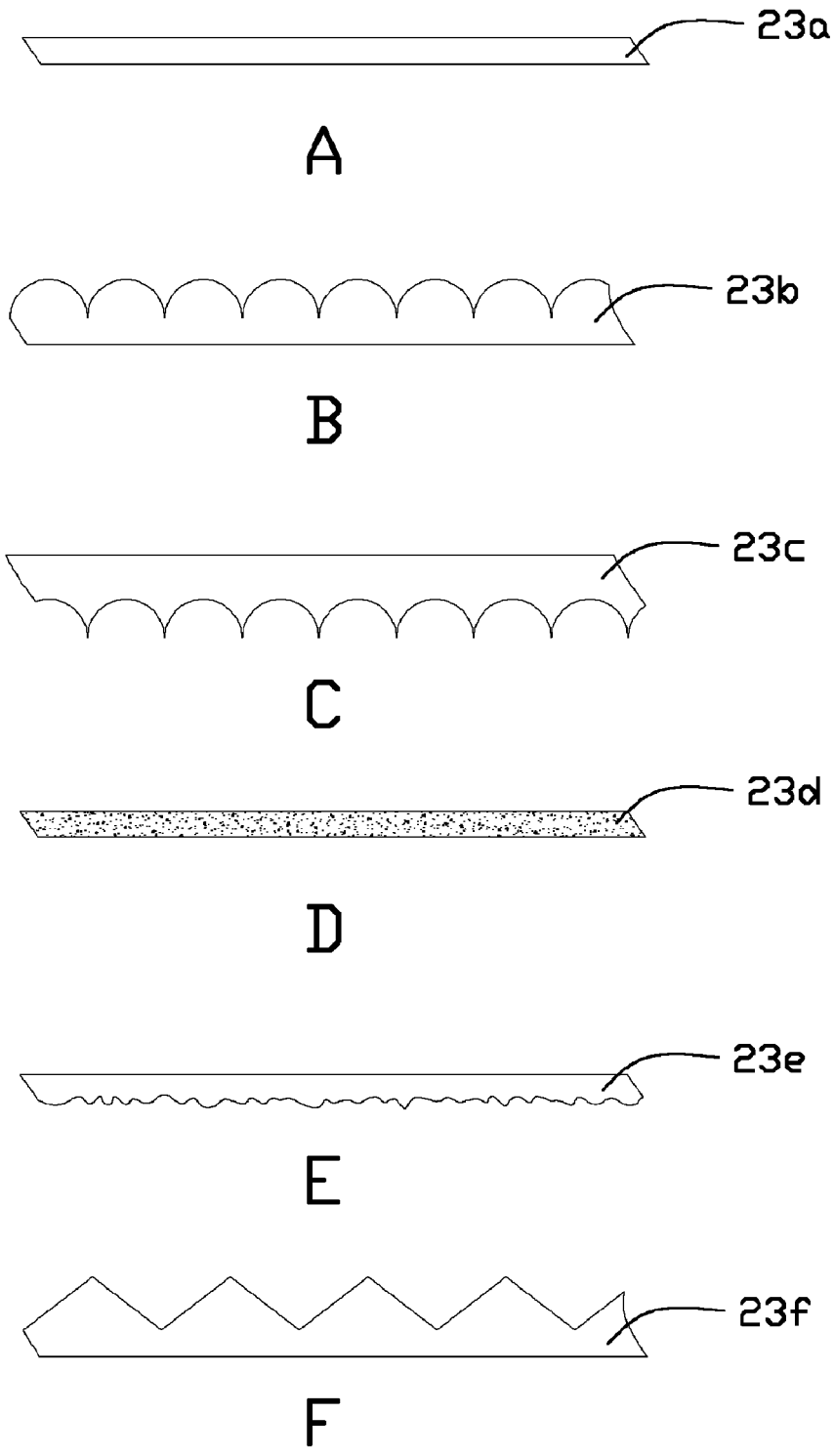
FIG. 4 are schematic, enlarged views showing different transparent front covers of a first illuminating module of the LED illuminating device of FIG. 1.

The transparent covers 23, 24, 32 vary by the shape and the structure, thus different illuminating effects are achieved. Referring to FIG. 4, different types of the transparent front covers 23 are shown with different structures. The transparent cover 23*a* is a normal transparent cover with a smooth surface. The transparent cover 23*b* includes bumps on its outer surface, which gather light. The transparent cover 23*c* defines concavities on its inner surface, which refract light and change the transmission direction of the light. Diffusion particles are added to the transparent cover 23*d* to scatter light. The transparent cover 23*e* has a roughness surface, which diffuse light. The transparent cover 23*f* includes triangular structures on its outer surface, which refract light.

Figure 5:
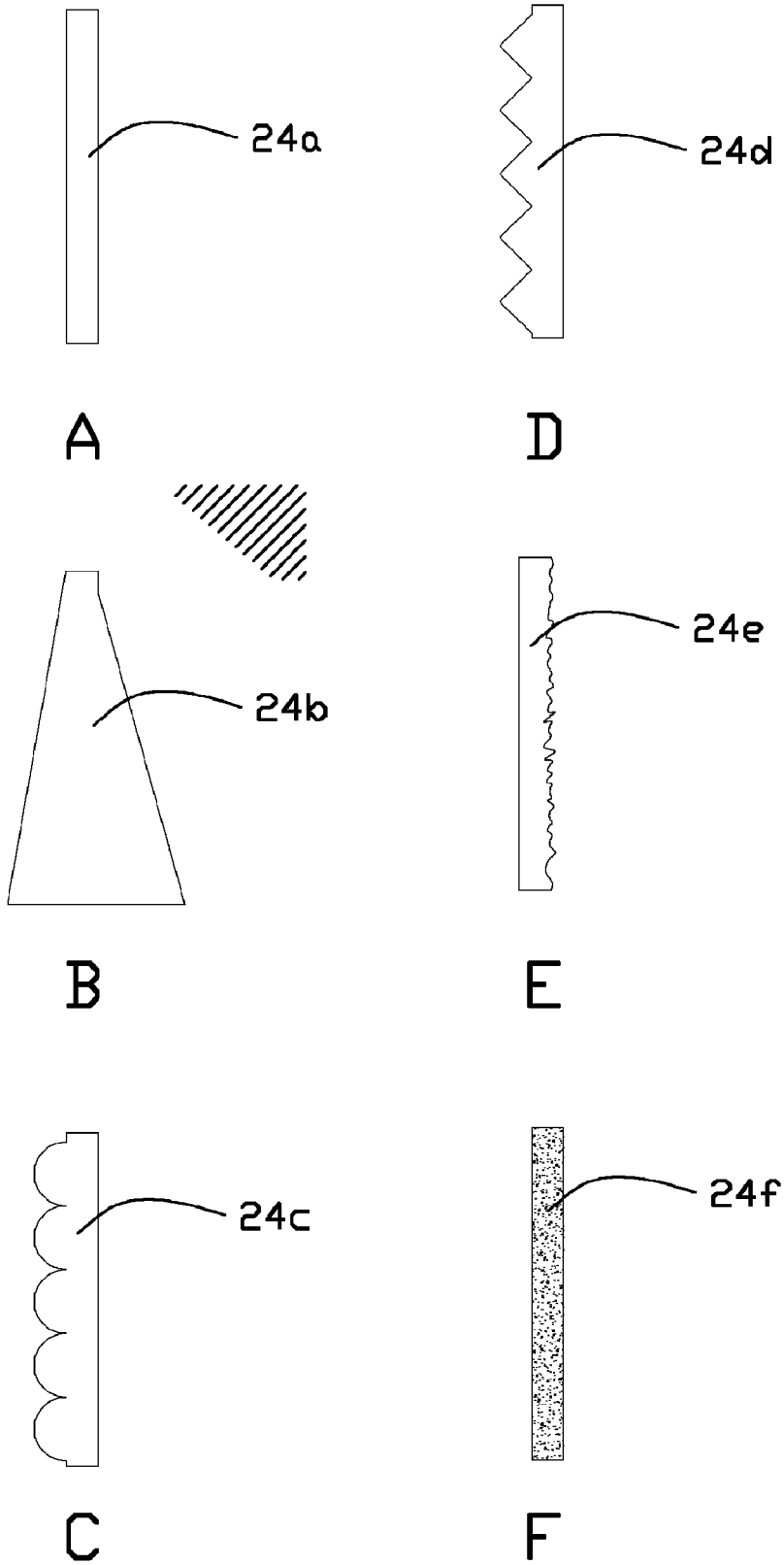
FIG. 5 are schematic, enlarged views showing different transparent lateral covers of the first illuminating module of the LED illuminating device of FIG. 1.

Referring to FIG. 5, different types of the transparent lateral covers 24 are shown with different structures. The transparent cover 24*a* is a normal transparent cover with a smooth surface. The transparent cover 24*b* is a wedge shaped transparent cover, which refract light. The transparent cover 24*c* includes bumps on its outer surface, which gather light. The transparent cover 24*d* includes triangular structures on its outer surface, which refract light. The transparent cover 24*e* has a roughness surface, which diffuse light. Diffusion particles are added to the transparent cover 24*f* to scatter light.

Figure 6:
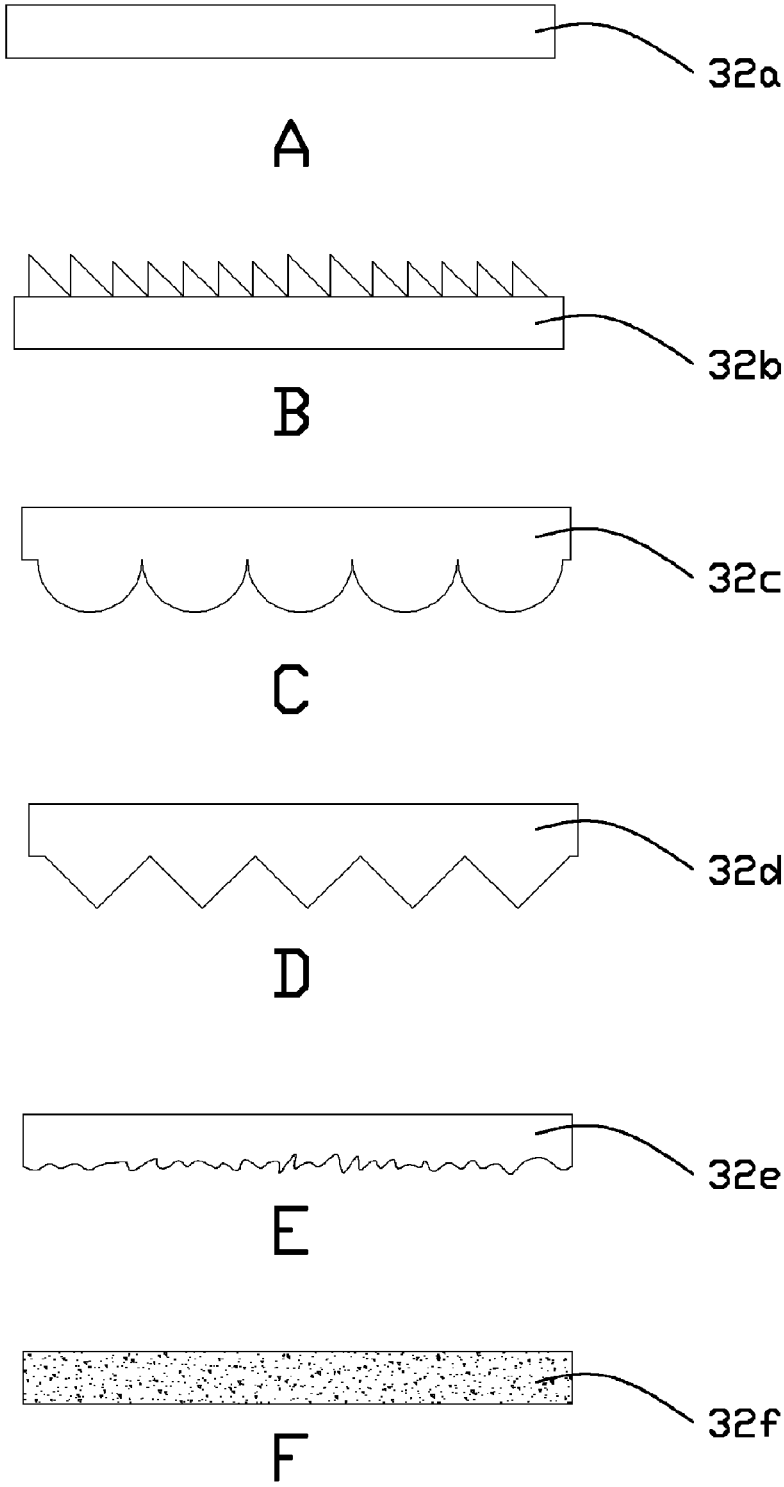
FIG. 6 are schematic, enlarged views showing different transparent covers of a second illuminating module of the LED illuminating device of FIG. 1.

Referring to FIG. 6, different types of the transparent covers 32 are shown with different structures. The transparent cover 32*a* is a normal transparent cover with a smooth surface. The transparent cover 32*b* includes zigzag structures on its inner surface, which refract light. The transparent cover 32*c* includes bumps on its outer surface, which gather light. The transparent cover 32*d* includes triangular structures on its outer surface, which refract light. The transparent cover 32*e* has a roughness surface, which diffuse light. Diffusion particles are added to the transparent cover 32*f* to scatter light.

Figure 7:
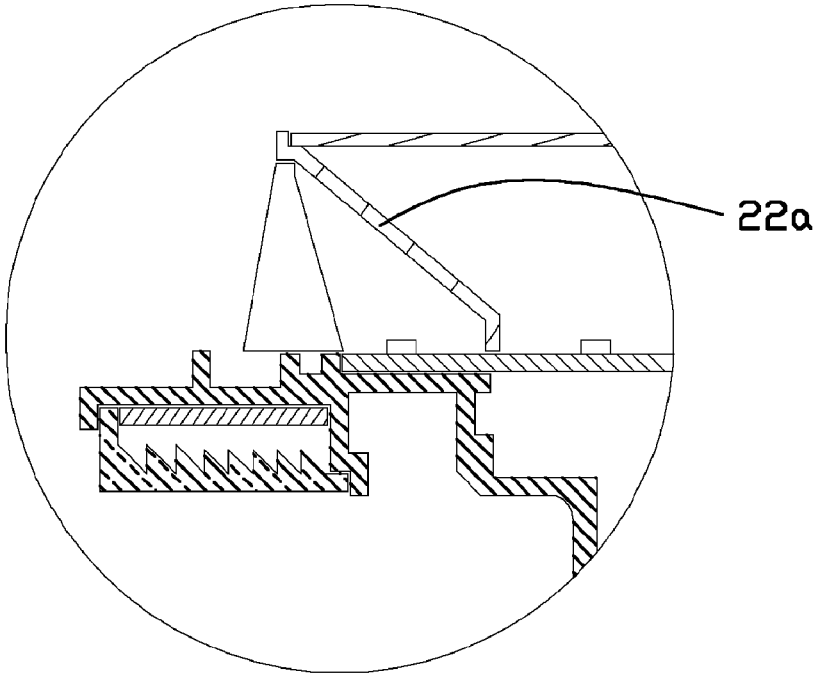
FIG. 7 are schematic, enlarged views showing different double-sided reflectors of the LED illuminating device of FIG. 1.
Figure 7:
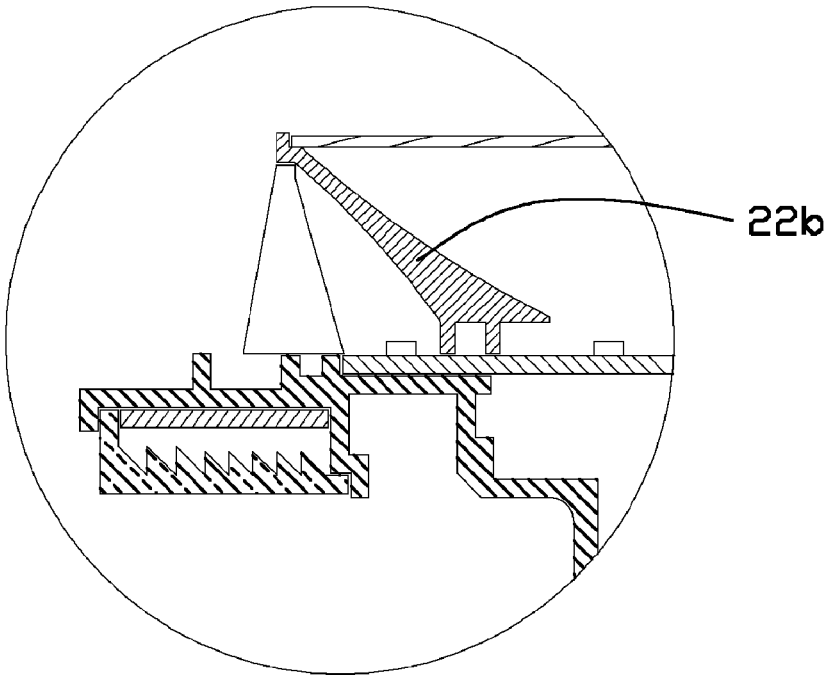

Referring to FIG. 7, the double-sided reflector 22 vary by shape, thus different illuminating effects are achieved. The reflector 22*a* is a normal reflector with plane reflective surfaces. The reflector 22*b* has curved reflective surfaces, which gather light.

Figure 8:
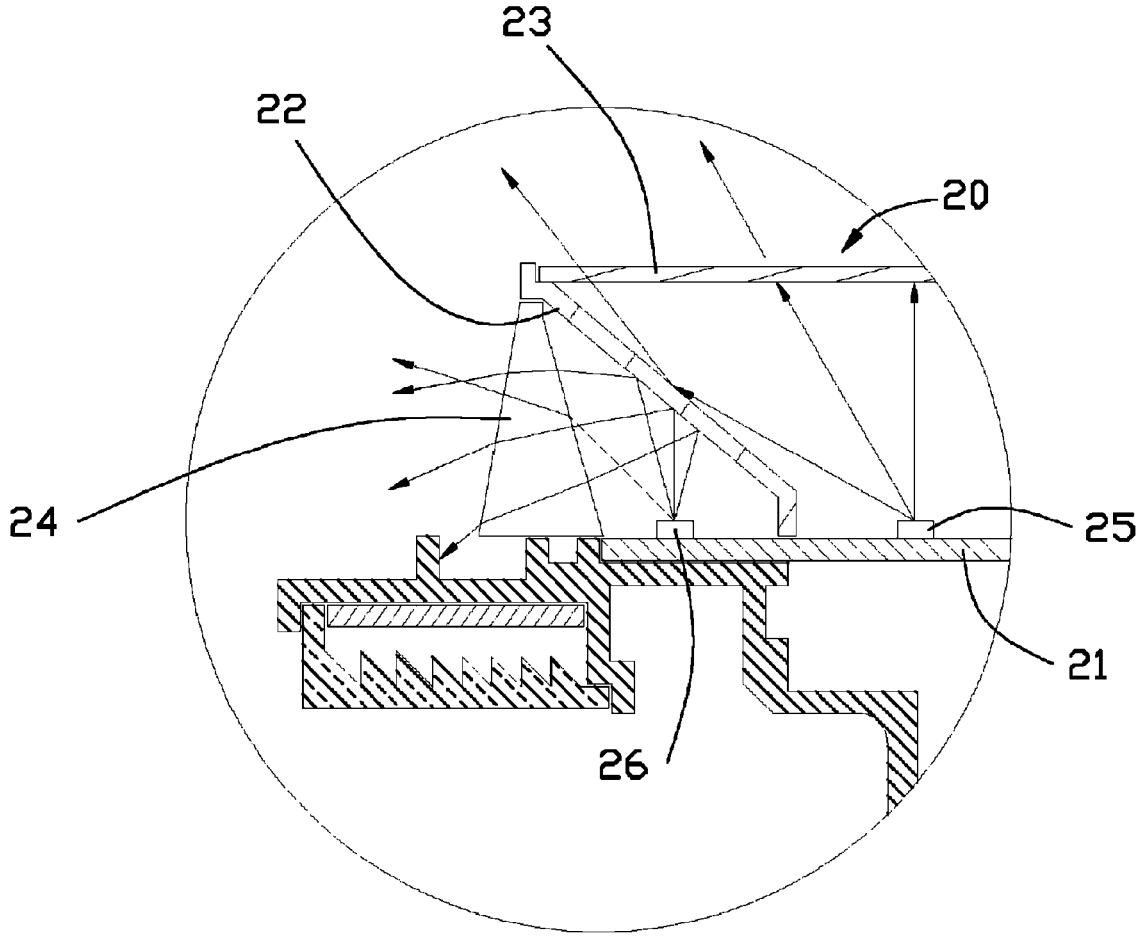
FIG. 8 is a schematic, cross-sectional view showing light characteristic of the first illuminating module of the LED illuminating device of FIG. 1.

FIG. 8 shows the light path of the first illuminating module 20. Light from the LEDs 25 is reflected by the double-sided reflector 22, then passes through the transparent front cover 23, thus to illuminate the front side of the first illuminating module 20. Light from the LEDs 26 is reflected by the double-sided reflector 22 and then passes through the transparent lateral cover 22 then illuminates the lateral side of the first illuminating module 20.

Figure 9:
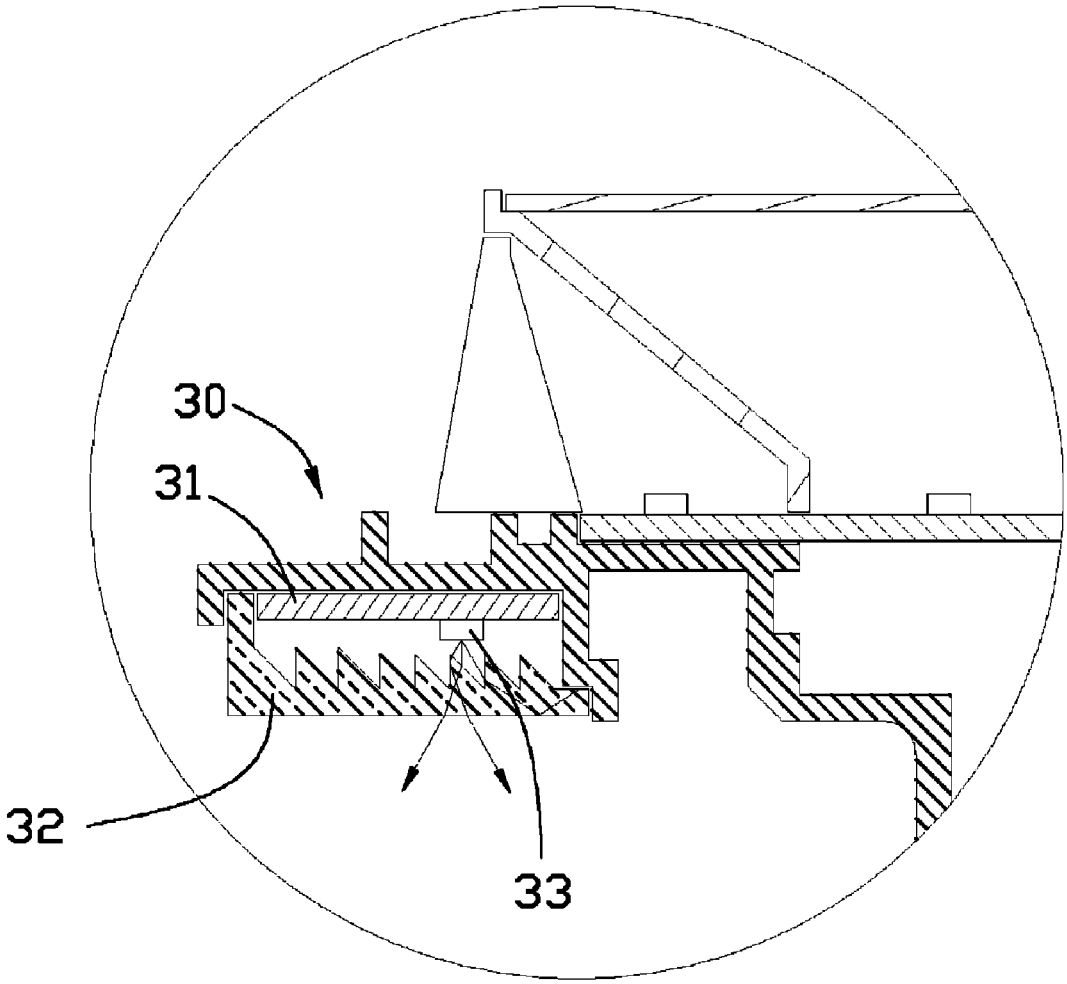
FIG. 9 is a schematic, cross-sectional view showing light characteristic of the second illuminating module of the LED illuminating device of FIG. 1.

FIG. 9 shows the light path of the second illuminating module 30. Light from the LEDs 33 passes through the transparent cover 32 then illuminates the front side of the second illuminating module 30.

Figure 10:
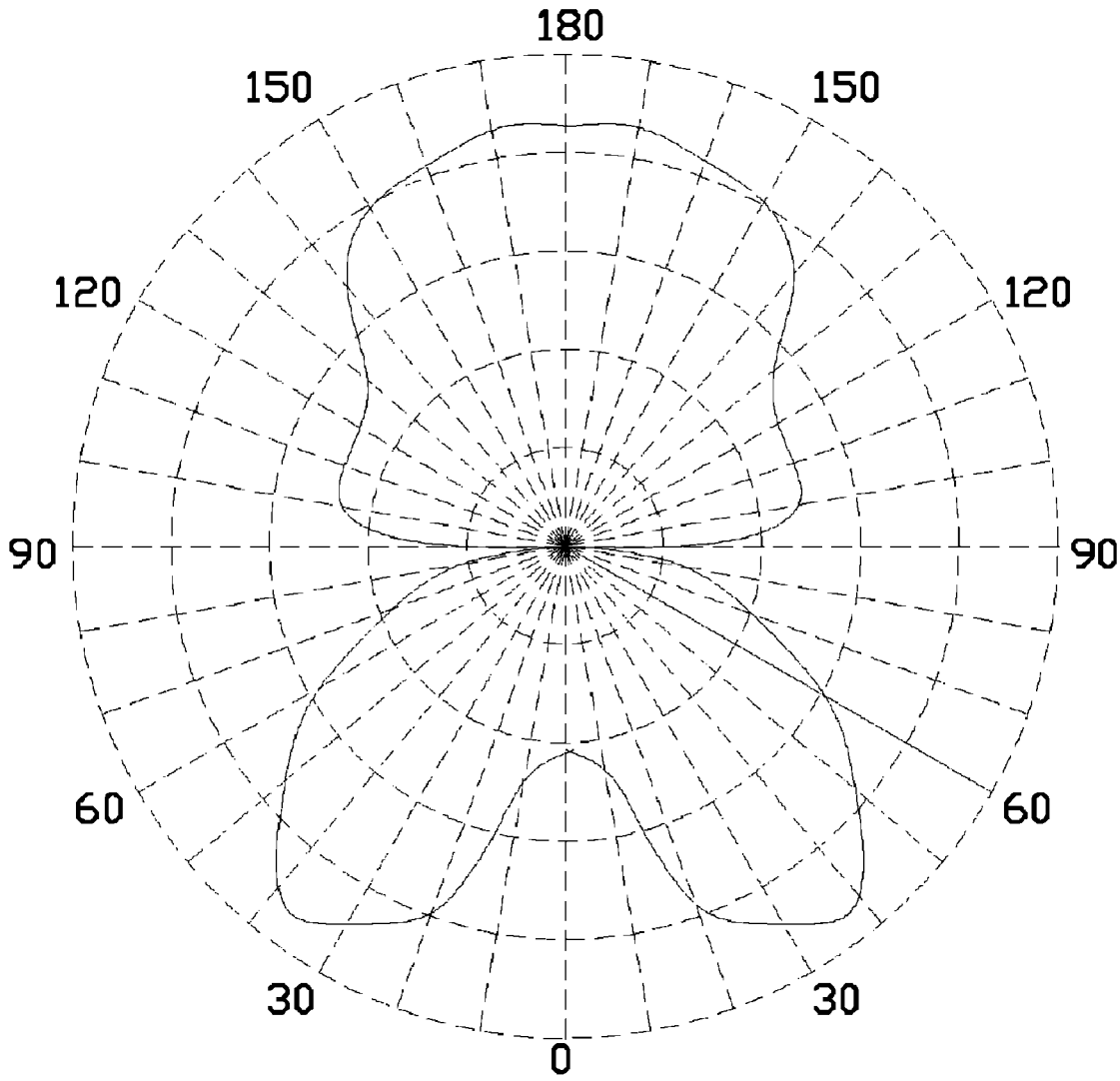
FIG. 10 is a light distribution curve chart of the LED illuminating device of FIG. 1.
Figure 11:
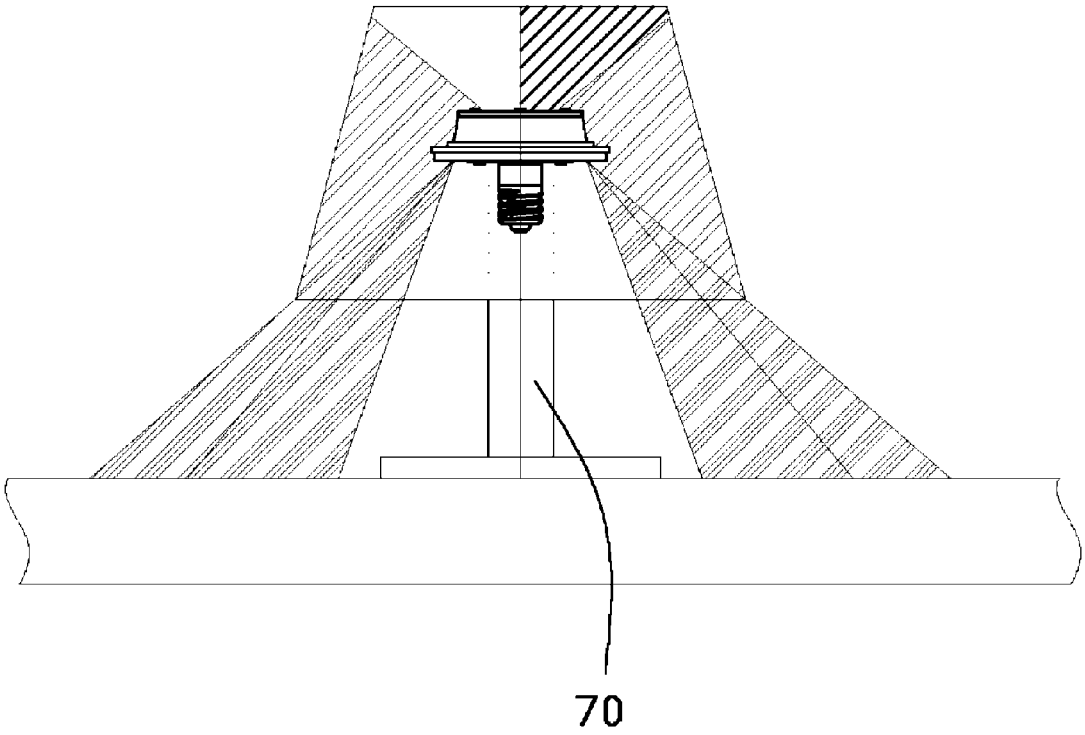
FIG. 11 is a schematic, cross-sectional view showing using the LED illuminating device of FIG. 1 as a reading lamp.
Figure 12:
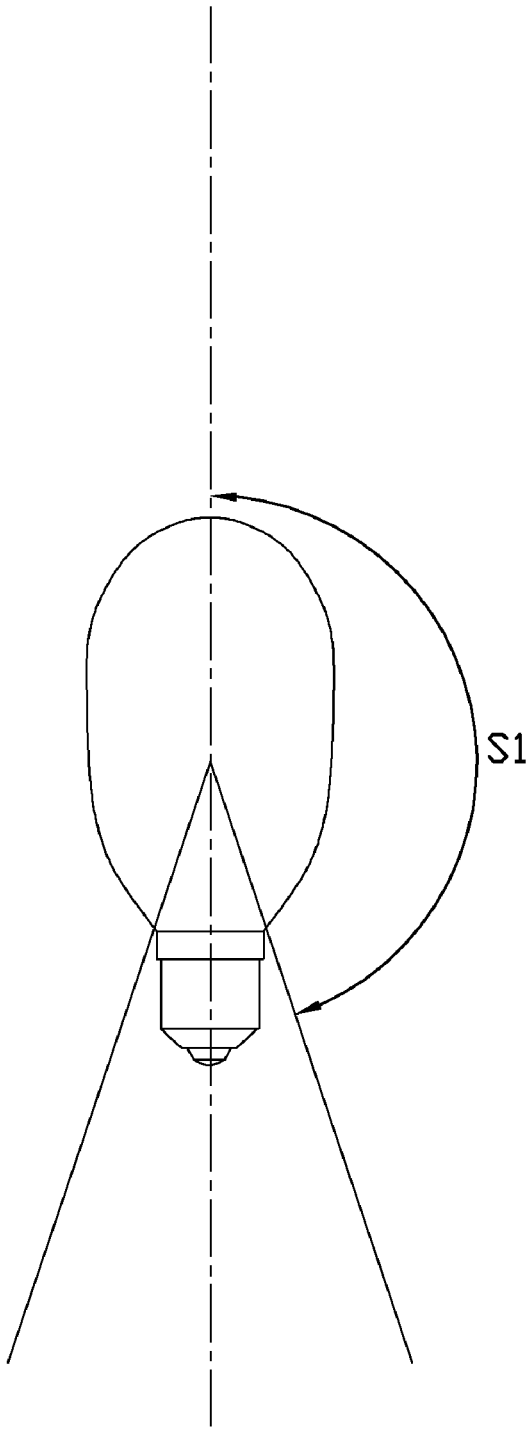
FIG. 12 (RELATED ART)
FIG. 12 is a schematic view showing the light divergence angle of a traditional light source.
Figure 13:
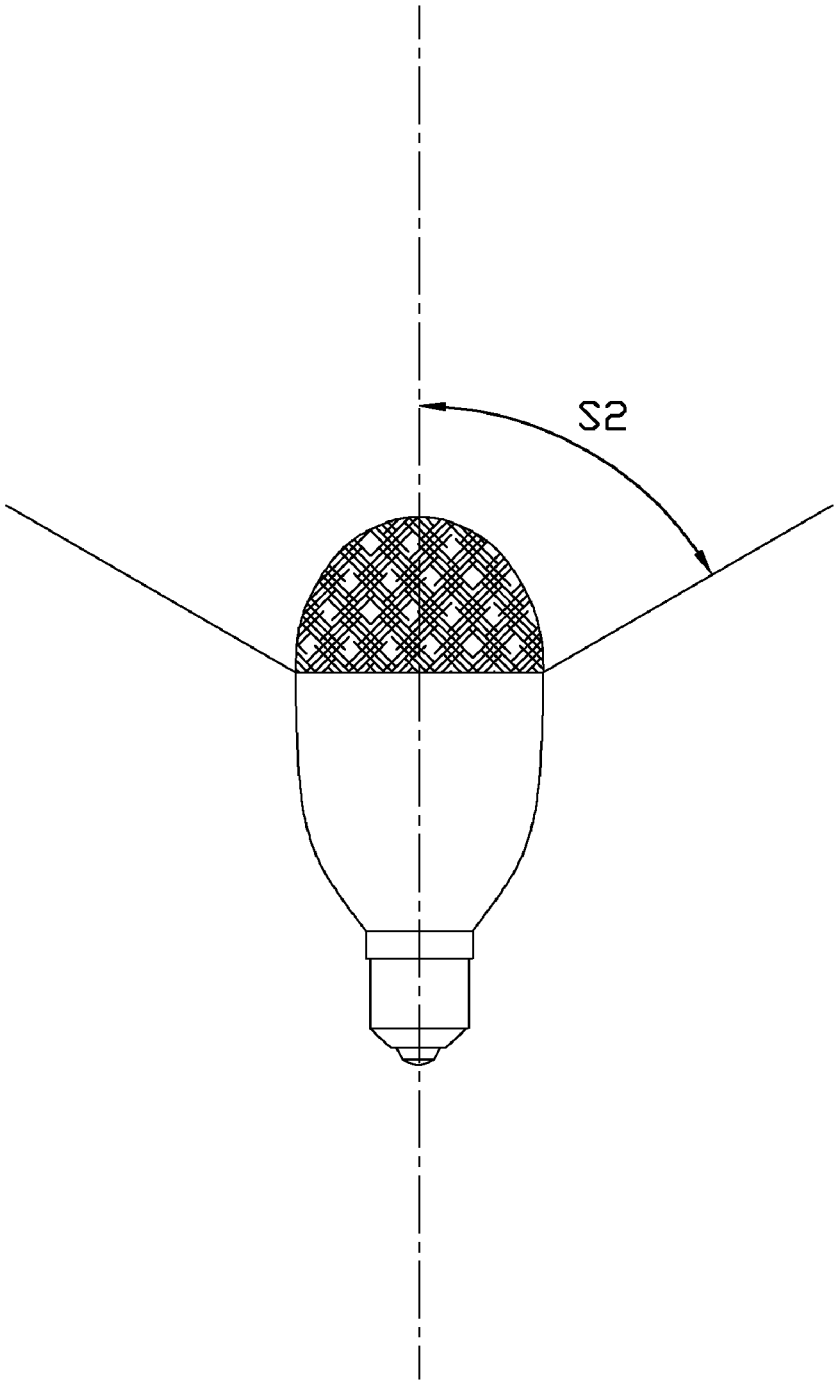
FIG. 13 (RELATED ART)
FIG. 13 is a schematic view showing the light divergence angle of an LED.
Figure 14:
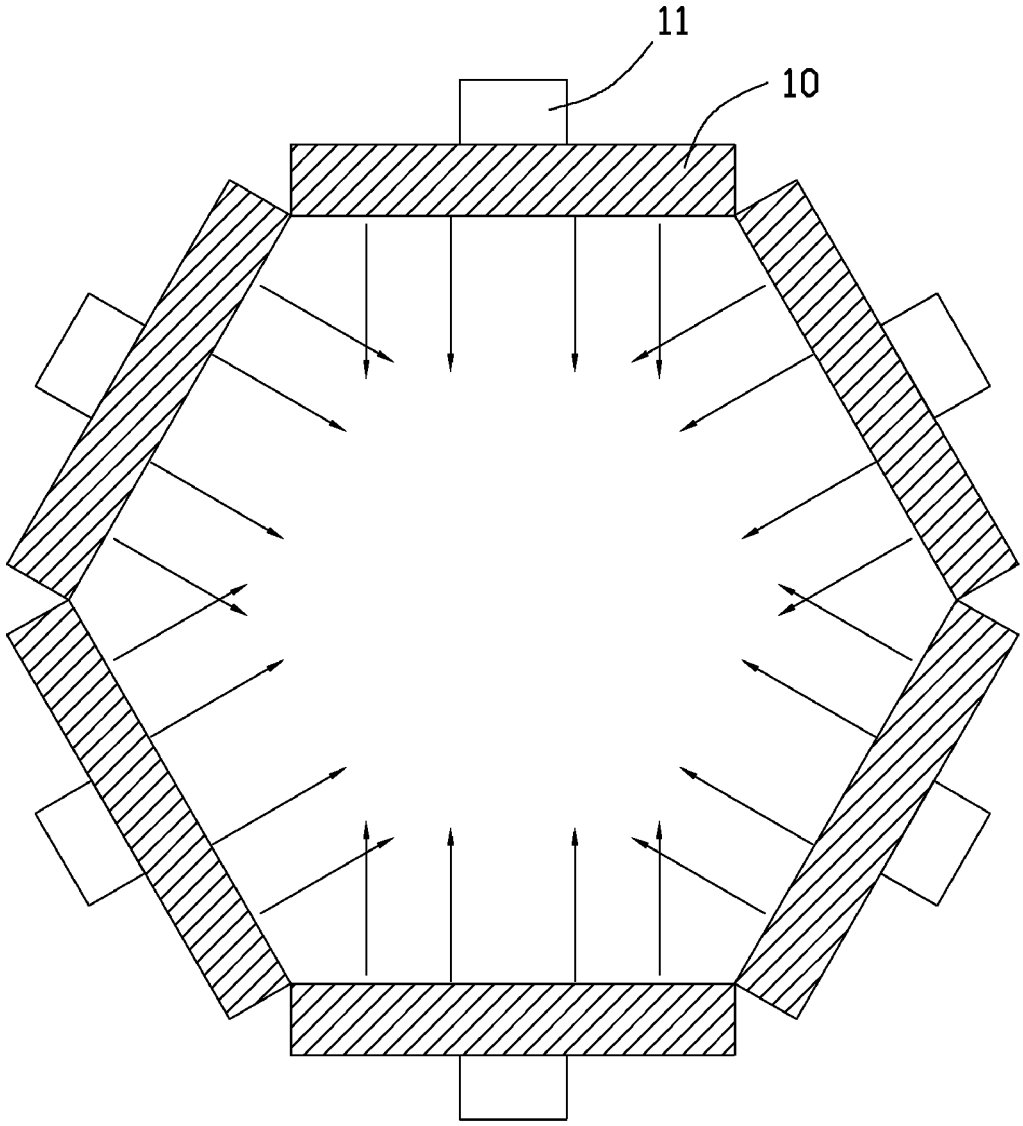
FIG. 14 (RELATED ART)
FIG. 14 is a schematic view showing heat dissipation of a ring shaped LED illuminating device.
Figure 15:
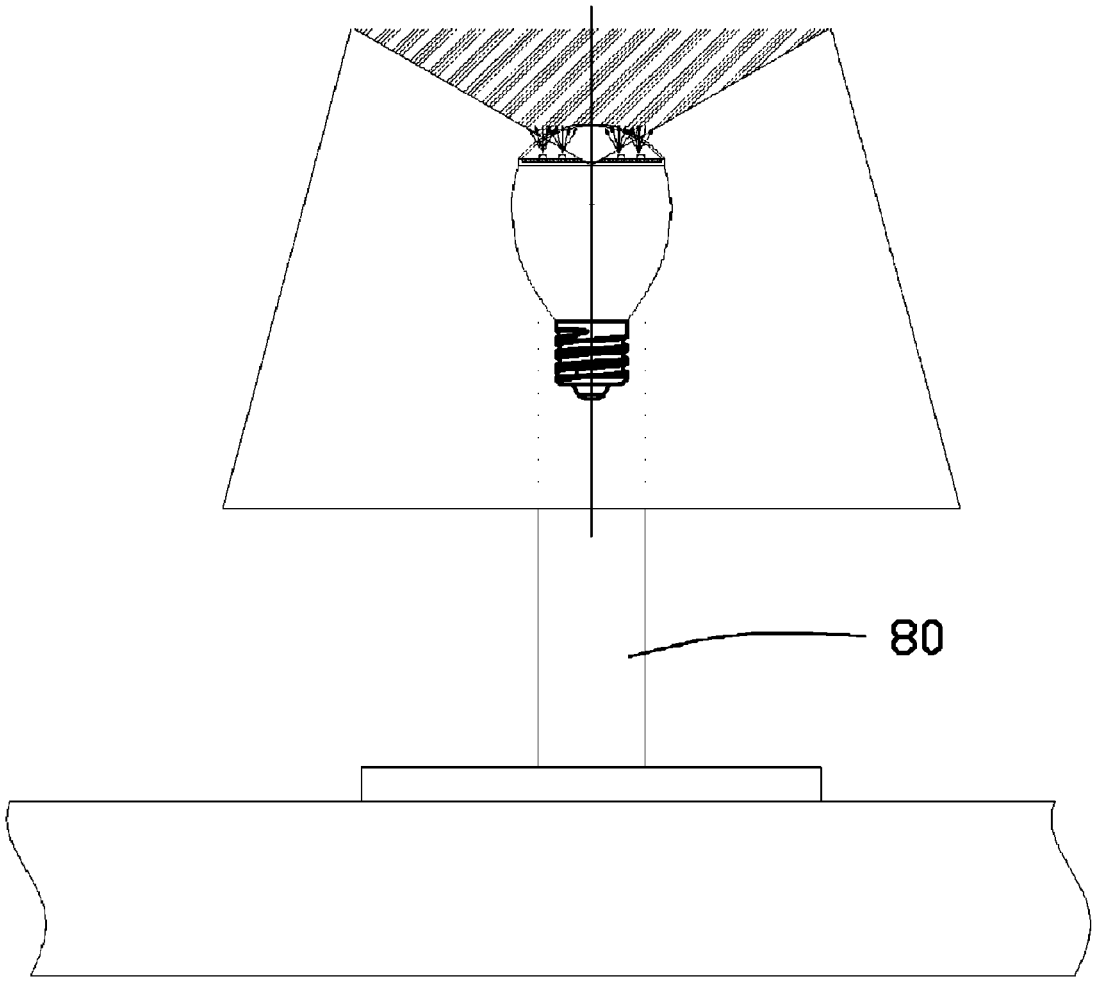
FIG. 15 (RELATED ART)
FIG. 15 is a schematic, cross-sectional view showing using a traditional LED as a reading lamp.

FIG. 10 is a light distribution curve chart of the LED illuminating device, we can see that the LED illuminating device can illuminate in three different directions at the same time. FIG. 11 shows using the LED illuminating device as a reading lamp 70. FIG. 15 shows using a traditional LED as a reading lamp 80. Comparing FIG. 11 with FIG. 15, we can see that the reading lamp 70 can illuminate in more directions than the reading lamp 80, thus achieving a better illuminating effect.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. An LED illuminating device comprising:

a first LED illuminating module comprising a first substrate carrying a double-sided reflector, a first group of LEDs, and a second group of LEDs, wherein the double-sided reflector divides the first LED illuminating module into a front lighting area and a lateral lighting area, the light emitted by the first group of LEDs is reflected by the double-sided reflector and illuminates the front lighting area, and light emitted by the second group of LEDs is reflected by the double-sided reflector and illuminates the lateral lighting area;

a second LED illuminating module comprising a second substrate and a third group of LEDs mounted on the second substrate, wherein the third group of LEDs are opposite to the first group of LEDs and the second group of LEDs, and the projections of the first substrate and the second substrate are spaced to each other; and a connecting module connecting the first LED illuminating module with the second LED illuminating module.

2. The LED illuminating device of claim 1, further comprising a transparent front cover mounted on a front side of the first substrate.

3. The LED illuminating device of claim 2, wherein the transparent front cover is one selected from the group consisting of a transparent cover with a smooth surface, a transparent cover comprising bumps on its outer surface, a transparent cover defining concavities on its inner surface, a transparent cover with diffusion particles, and a transparent cover comprising triangular structures on its outer surface.

4. The LED illuminating device of claim 1, further comprising a transparent lateral cover mounted on a lateral side of the first substrate.

5. The LED illuminating device of claim 4, wherein the transparent lateral cover is one selected from the group consisting of a transparent cover with a smooth surface, a wedge shaped transparent cover, a transparent cover comprising bumps on its outer surface, a transparent cover comprising triangular structures on its outer surface, a transparent cover comprising a roughness surface, and a transparent cover defining concavities on its inner surface.

6. The LED illuminating device of claim 1, further comprising a transparent cover mounted on the second substrate.

7. The LED illuminating device of claim 6, wherein the transparent lateral cover is one selected from the group consisting of a transparent cover with a smooth surface, a transparent cover comprising zigzag structures on its inner surface, a transparent cover comprising bumps on its outer surface, a transparent cover comprising triangular structures on its outer surface, a transparent cover comprising a roughness surface, and a transparent cover with diffusion particles.

8. The LED illuminating device of claim 1, wherein the double-sided reflector 22 is one selected from the group consisting of a reflector with plane reflective surfaces and a reflector with curved reflective surfaces.

9. An LED illuminating device comprising:

a first substrate;

a first group of LEDs and a second group of LEDs mounted on the same surface of the first substrate, the projections of the first group of LEDs and the second group of LEDs being spaced to each other; and an oblique double-sided reflector mounted on the first substrate and dividing the first substrate into a front lighting area and a lateral lighting area, the light emitted by the first group of LEDs being reflected by the double-sided reflector and illuminating the front lighting area, and light emitted by the second group of LEDs being reflected by the double-sided reflector and illuminating the lateral lighting area.

10. The LED illuminating device of claim 9, further comprising:

a second substrate; and a third group of LEDs mounted on the second substrate, the third group of LEDs being opposite to the first group of LEDs and the second group of LEDs.

11. The LED illuminating device of claim 9, further comprising a connecting module, the connecting module connecting the first substrate with the second substrate.

12. The LED illuminating device of claim 9, further comprising a transparent front cover mounted on a front side of the first substrate.

13. The LED illuminating device of claim 12, wherein the transparent front cover is one selected from the group consisting of a transparent cover with a smooth surface, a transparent cover comprising bumps on its outer surface, a transparent cover defining concavities on its inner surface, a transparent cover with diffusion particles, and a transparent cover comprising triangular structures on its outer surface.

14. The LED illuminating device of claim 9, further comprising a transparent lateral cover mounted on a lateral side of the first substrate.

15. The LED illuminating device of claim 14, wherein the transparent lateral cover is one selected from the group consisting of a transparent cover with a smooth surface, a wedge shaped transparent cover, a transparent cover comprising bumps on its outer surface, a transparent cover comprising triangular structures on its outer surface, a transparent cover comprising a roughness surface, and a transparent cover defining concavities on its inner surface.

16. The LED illuminating device of claim 9, further comprising a transparent cover mounted on the second substrate.

17. The LED illuminating device of claim 16, wherein the transparent lateral cover is one selected from the group consisting of a transparent cover with a smooth surface, a transparent cover comprising zigzag structures on its inner surface, a transparent cover comprising bumps on its outer surface, a transparent cover comprising triangular structures on its outer surface, a transparent cover comprising a roughness surface, and a transparent cover with diffusion particles.

18. The LED illuminating device of claim 9, wherein the double-sided reflector 22 is one selected from the group consisting of a reflector with plane reflective surfaces and a reflector with curved reflective surfaces.

* * * * *